United States Patent [19]

Pfarrwaller

[11] 4,005,736

[45] Feb. 1, 1977

[54] ECCENTRIC MECHANISM FOR DRIVING A PLURALITY OF HEDDLE CARRYING FRAMES

[75] Inventor: Erwin Pfarrwaller, Winterthur, Switzerland

[73] Assignee: Sulzer Brothers Limited, Winterthur, Switzerland

[22] Filed: July 2, 1975

[21] Appl. No.: 592,675

[30] Foreign Application Priority Data

July 29, 1974 Switzerland ..... 10371/74

[52] U.S. Cl. ..... 139/79

[51] Int. Cl.² ..... D03D 5/02

[58] Field of Search ..... 139/79–81, 139/55–57, 66; 74/512

[56] References Cited

UNITED STATES PATENTS

| | | | |
|---|---|---|---|
| 889,971 | 6/1908 | Salisbury | 139/57 X |
| 1,718,198 | 6/1929 | Almond | 139/79 X |
| 2,592,820 | 4/1952 | Moessinger | 139/79 X |
| 2,687,148 | 8/1954 | Pfarrwaller | 139/79 X |
| 2,693,828 | 11/1954 | Nims | 139/57 |
| 2,750,966 | 6/1956 | Brouwer et al. | 139/79 |
| 2,980,145 | 4/1961 | Herard, Jr. et al. | 139/80 |

FOREIGN PATENTS OR APPLICATIONS

| | | | |
|---|---|---|---|
| 458,984 | 8/1950 | Italy | 139/79 |
| 639,771 | 7/1960 | United Kingdom | 139/79 |
| 220,874 | 9/1968 | U.S.S.R. | 139/79 |
| 272,166 | 9/1970 | U.S.S.R. | 139/80 |

*Primary Examiner*—James Kee Chi
*Attorney, Agent, or Firm*—Kenyon & Kenyon Reilly Carr & Chapin

[57] ABSTRACT

The eccentric mechanism includes deflecting levers which are rotatably mounted on a fixed spindle and which bear against bearing elements in order to preclude an accumulation of tilting forces along the line of the levers. Each bearing element has a disc-shaped portion located between two levers and cooperates with a bushing, separate or integral, or a shaft portion to mount a lever.

8 Claims, 5 Drawing Figures

8
12
12a
25
26
11
10
31
32
27
24
34
35
13
13a
15
A
B

ECCENTRIC MECHANISM FOR DRIVING A PLURALITY OF HEDDLE CARRYING FRAMES

This invention relates to an eccentric mechanism for driving a plurality of heddle carrying frames in a weaving machine.

Heretofore, various eccentric mechanisms have been used to drive the shafts, i.e. heddle carrying frames, of a weaving machine. Generally, such mechanisms have used a plurality of eccentrics, cooperating cam follower levers and deflecting levers to drive frame actuating linkages secured to the frames. In addition, the deflecting levers have been rotatably mounted on a spindle so as to rock back and forth while driving the frame actuating linkages.

In one known mechanism of this kind, the deflecting levers are so mounted on their spindle as to be contiguous with one another in the region around the spindle. For reasons connected with the technique of weaving, the width of a complete group of frames, amounting e.g. to from 10 to 20 frames of the weaving machine is usually less than the width of the complete group of deflecting levers as measured along the spindle on which the levers are mounted. Consequently, if the number of deflecting levers is relatively large, the deflecting-lever end connected to a linkage must have a pronounced bend. Because of such bends, when the frames are actuated by the deflecting levers, the deflecting levers experience tilting moments which tend to pivot the levers perpendicularly to the spindle.

In the known construction described, the tilting moments and the associated forces act substantially parallel to the spindle and may be cumulative over all or some of the deflecting levers, due to the levers being contiguous with one another. Consequently, during operation the tilting moments can lead to very considerable amounts of friction between the individual levers and to relatively heavy wear of the bearing bushes and of the lever-bearing spindle. Further, these forces have to be dealt with in a cumulative manner.

Accordingly, it is an object of the invention to provide a mechanism which is able to preclude the accumulation of tilting moments between a series of deflecting levers in the heddle frame drive mechanism of a weaving machine.

It is another object of the invention to reduce wear in a heddle frame drive mechanism.

Briefly, the invention is directed to an eccentric mechanism for driving a plurality of heddle carrying frames in a weaving machine. This mechanism includes a plurality of eccentrics and cam follower levers with the levers arranged to move under the influence of the eccentrics as well as a fixedly mounted spindle on which a plurality of deflecting levers are mounted for example via bushings and connected to a respective cam follower level. In accordance with the invention, a plurality of bearing elements, each of which has a flange portion, and an annular bushing portion are disposed in alternating manner between the deflecting levers. These bearing elements are individually mounted on the spindle so as to be inhibited from moving along the spindle.

The bearing elements preclude the tilting moments due to the individual bends of the deflecting levers to be cumulative. Instead, each individual tilting moment can be taken up by the associated bearing element and transmitted therethrough to the lever-carrying spindle — i.e. to the machine frame. Severe friction and heavy wear of the deflecting levers, bearing bushings and bearing spindle are thus reduced.

The deflecting levers, as known, are connected to heddle frame actuating linkages for imparting movement of the heddle frames.

These and other objects and advantages of the invention will become more apparent from the following detailed description and appended claims taken in conjunction with the accompanying drawings in which:

Figure 1:
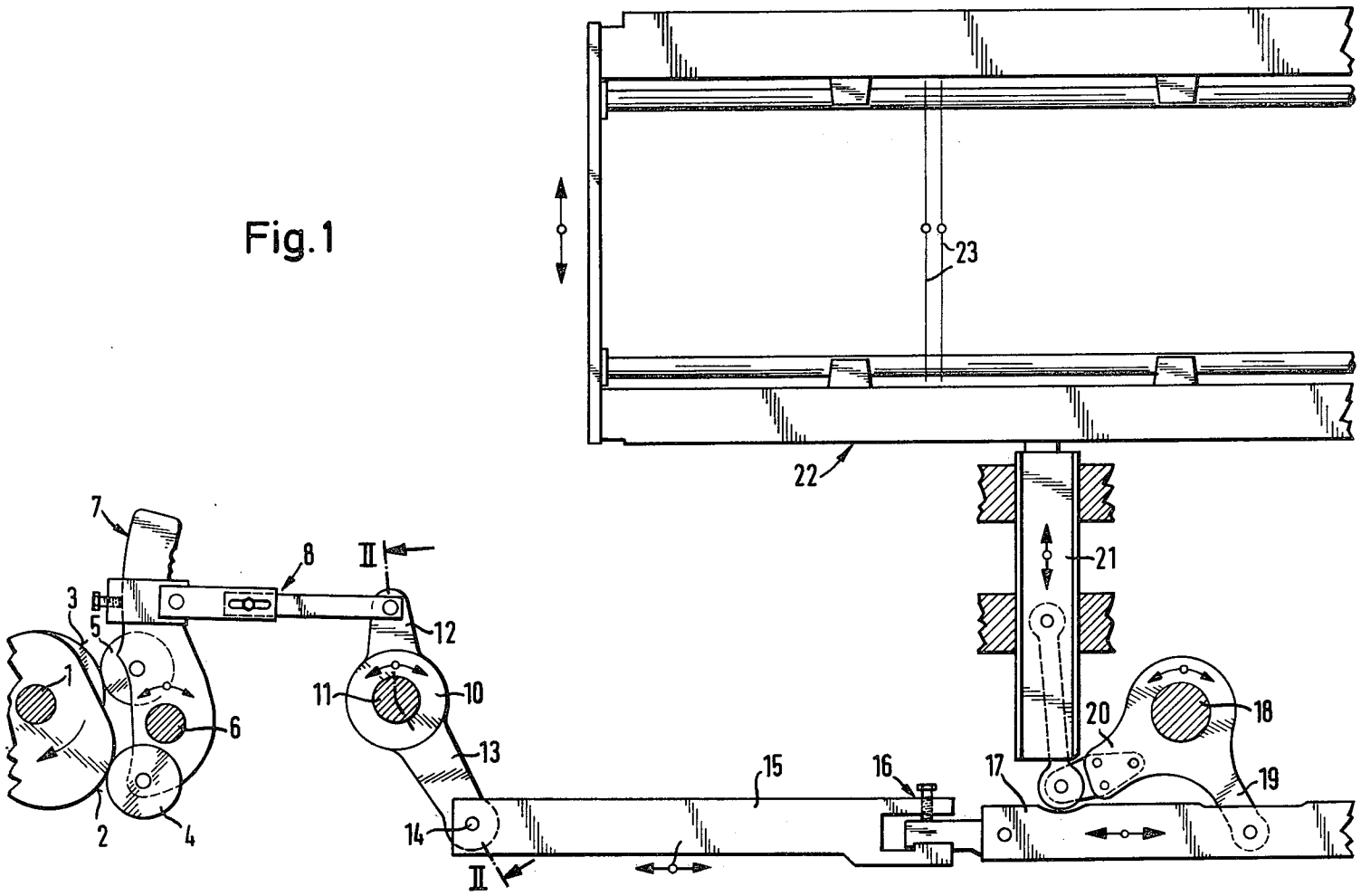
FIG. 1 illustrates certain important parts of an eccentric mechanism for heddle frames in a weaving machine.

Referring to FIG. 1, a weaving machine of known construction has a plurality of heddle carrying frames such as described in U.S. Pat. No. 3,696,842 which are driven via an eccentric mechanism. This mechanism includes a shaft 1 which is driven off the main shaft of an associated weaving machine and carries a number of eccentrics, only two 2, 3, of which are shown. The eccentrics 2, 3 form an associated pair cooperating with rollers or cam-followers 4, 5 of a cam-follower lever 7 which is mounted for pivoting around a spindle 6. Each lever 7 is pivotally connected by way of an adjustable link 8 to one arm 12 of a double-arm deflecting lever 12, 13 pivoted to a spindle 11. The other arm 13 of each lever is connected at a place 14 to a shaft actuating linkage comprising a guide rod 15, a rod 17 connected to the guide rod 15 by a hook connection 16, a bell crank lever 19, 20 pivotable around a pivot 18, and a vertical bar 21. The bar 21 functions as a lifter and is connected to a heddle frame 22 which carries warp heddles 23 for guiding warp yarns (not shown) for the shedding motions during weaving.

Figure 2:
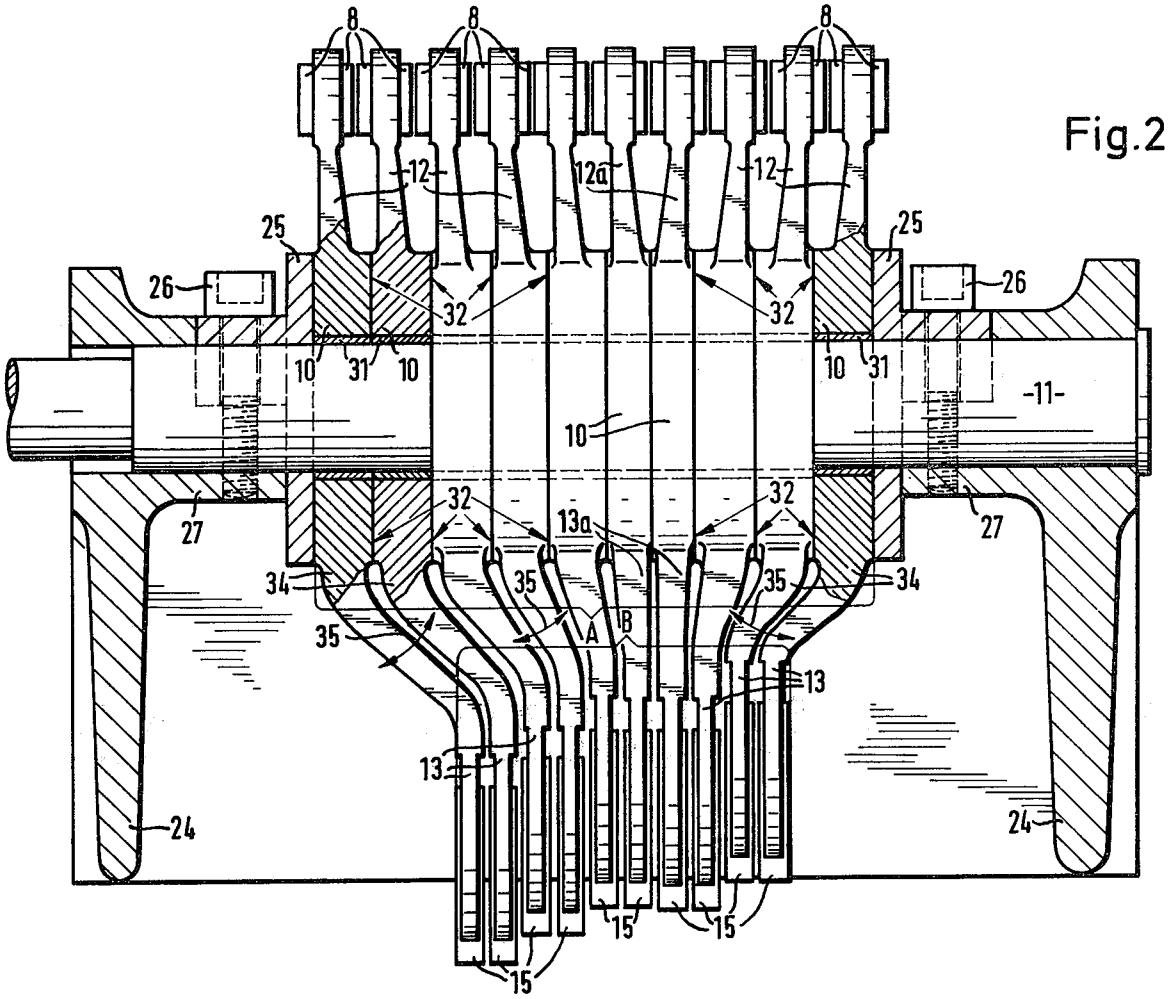
FIG. 2 illustrates a view taken on line II—II of FIG. 1 and shows a known construction for comparison purposes.

In the known construction shown in FIG. 2, the deflecting-lever spindle 11 is non-rotatably mounted in a machine frame 24. To this end, the spindle or shaft 11 is clamped fast at each end in flanges 27 of the frame 24 by means of a disc or the like 25 and screws 26. Each lever 12, 13 is pivotally mounted on the spindle 11 with the interposition of an insert bushing 31, the annular portions 10 of the various levers 12, 13 being contiguous with one another.

The total width A of all the levers 12, 13 in the annular portions 10 as measured along the spindle 11 — i.e. the total width of the deflecting-lever group — is greater than the total width B of all the rods 15, the width B corresponding to the total width of all the frames 22 — i.e. the frame group. Accordingly, the arms 13 of the levers 12, 13 have bends 34 of varying extents.

Referring to FIG. 2, two deflecting levers **12*a*, 13*a* are shown thinner than the others because the associated rods 15 are disposed in the pivoting plane of the levers 12*a*, 13*a* and the arms 13*a* are unbent. The arms 13 of the levers 12 shown in the left-hand part of FIG. 2 are longer than in the case of the levers in the right-hand part of FIG. 2, since the arms 13** on the left of FIG. 2 are for use with frames which, as seen from the cloth end of the weaving machine, are disposed further back in the shed where the greater frame movement is needed.

In operation, the presence of the bends 34 leads to tilting moments tending to pivot the deflecting levers 12, 13 approximately in the direction indicated by arrows 35. Because there is direct contact between the deflecting levers in the regions 32, the tilting moments may become cumulative and be transmitted uncontrollably to the spindle 11 and frame 24, with the result of considerable friction in the region 32 and wear of spindle 11 and bushings 31.

Figure 3:
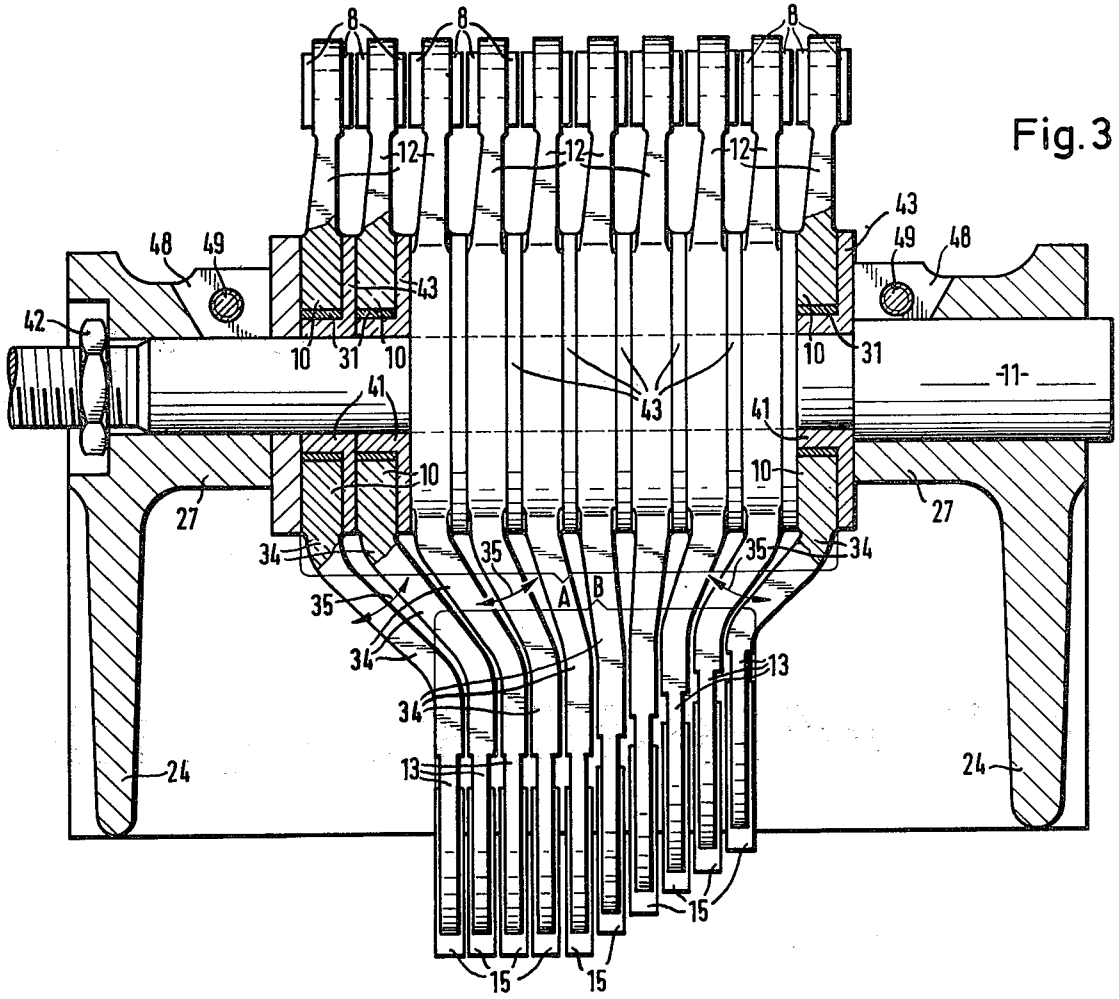
FIG. 3 illustrates a sectional view similar to FIG. 2 through a construction according to the invention.

In the construction according to the invention and shown in FIG. 3, wherein like reference characters indicate like parts as above, bearing elements having annular bushing portions 41 are disposed on the spindle 11 and are clamped axially by means of a nut 42. Each bearing element also has a flange portion 43 which acts as a disc-shaped bearing element and which extends between every two adjacent arms 12, 13 and is inhibited from movement along the spindle 11. The deflecting levers 12, 13 are pivotally mounted, by way of their annular parts 10, on the bushing portions 41 with the interposition of bushings 31.

During use, tilting moments of the levers 12, 13 cannot be cumulative. Instead, any tilting moment arising from any single bend 34 is taken up by the corresponding disc-shaped portion 43 and transmitted via the associated annular portion 41 to the frame 24.

As shown in FIG. 3, each frame flange 27 is formed with a slot 48 and has a screw 49 for clamping the spindle 11 fast in frame 24. Also, all the deflecting levers 12, 13 are of the same thickness (of the same width) and are as thick as the levers **12*a*, 13*a* of FIG. 2, since the deflecting levers shown in FIG. 3** are carried individually and so the tilting moments are not cumulative but are transmitted individually.

Figure 4:
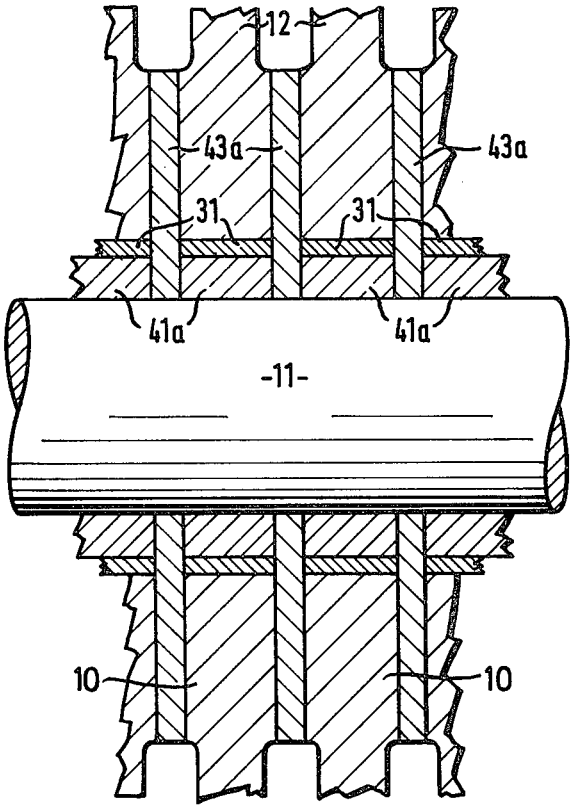
FIG. 4 illustrates a modified structure according to the invention.

Referring to FIG. 4, the bearing elements may alternately each be made of separate portions using a disc-shaped part **43*a* between two levers 12, 13 and a separate bushing part 41*a* between a lever and the shaft 11. As shown, the disc-shaped parts 43*a* are clamped between the bushing parts 41a. The parts 43 need not necessarily be of annular shape, the important consideration being that an axially locked element should extend between every two deflecting levers 12, 13 — i.e. the annular portions 10 thereof — so that the tilting moments 35** can be dealt with individually.

Figure 5:
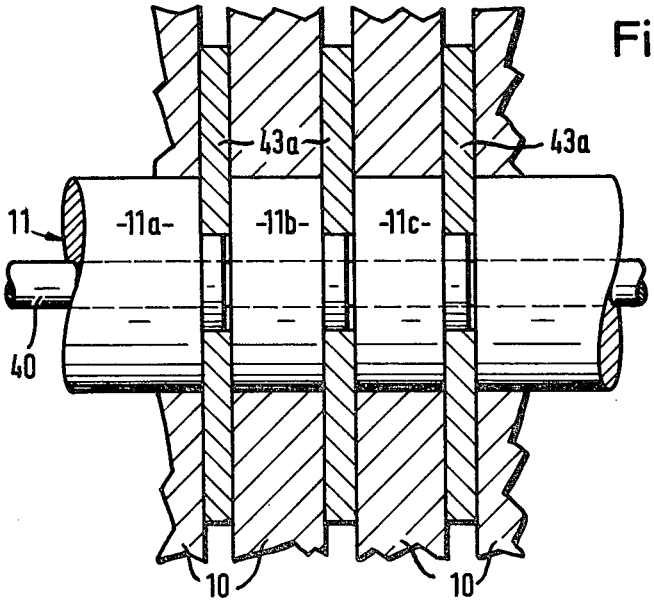
FIG. 5 illustrates a further modified structure according to the invention.

Referring to FIG. 5, the bearing elements **43*a* may also be solely in the form of discs which are secured to the spindle 11. For instance, the spindle 11 can take the form of a number of portions or sections 11*a*, 11*b*, 11*c* which are tightened against one another by means of a pull or draw rod 40 and which clamp the bearing elements 43*a* between these sections 11*a*, 11*b*, 11*c***.

In another construction using one-piece bearing elements 41, 43 of the kind shown in FIG. 3, the bushing parts 41 are not clamped axially against one another but are contiguous with one another without being forced into contact. In this case also there is no accumulation of tilting moments since the tilting moments are transmitted individually through the bushing parts 41 to the spindle 11.

In another form, the link 8 (FIG. 1) can be pivoted directly to the arm 19 of the bell-crank lever 19, 20, the bell-crank lever then serving as a deflecting lever which corresponds to the deflecting lever 12, 13 of FIG. 1 and which has bearing elements 43 or **43*a* as in the case of FIG. 3 or FIG. 4**.

What is claimed is:

1. An eccentric mechanism for driving a plurality of heddle carrying frames in a weaving machine, said mechanism comprising a plurality of rotatable eccentrics;

a plurality of cam follower levers, each said lever being positioned relative to a respective eccentric to be moved thereby;

a fixedly mounted spindle;

a plurality of deflecting levers rotatably mounted on said spindle, each said deflecting lever being pivotally connected to a respective cam follower lever;

a plurality of bearing elements, each said element having an annular bushing portion and a flange portion disposed between a respective pair of adjacent deflecting levers; and means connected to each said deflecting lever to raise and lower a heddle carrying frame.

2. An eccentric mechanism as set forth in claim 1 wherein each said annular bushing portion is disposed on said spindle and has a respective deflecting lever pivotally mounted thereon.

3. An eccentric mechanism as set forth in claim 2 which further comprises a frame member clamping at least one end of said spindle therein and a screwthreaded means at the opposite end of said spindle for axially tightening said bushing portions together.

4. An eccentric mechanism as set forth in claim 1 which further includes a plurality of annular bushings, each said bushing being mounted on a respective one of said bushing portions between a pair of adjacent flange portions of said bearing elements and concentric with a respective deflecting lever.

5. An eccentric mechanism as set forth in claim 4 which further comprises a frame member clamping said spindle therein at least at one end of said spindle and a screwthreaded means at an opposite end of said spindle for axially tightening said bushings together.

6. In combination, a plurality of heddle conveying frames;

a plurality of frame actuating linkages, each linkage being connected to a respective frame;

a plurality of movable eccentrics;

a plurality of cam follower levers, each said lever being positioned relative to a respective eccentric to be moved thereby;

a spindle;

a plurality of deflecting levers rotatably mounted on said spindle, each said deflecting lever being pivotally connected to and between a respective cam follower lever and a respective actuating linkage; and a plurality of bearing elements, each said element having an annular bushing portion and a flange portion disposed between a respective pair of adjacent levers and about said spindle.

7. In an eccentric mechanism for driving a plurality of heddle carrying frames of a weaving machine, the combination of a spindle, a plurality of double-arm levers rotatably mounted on said spindle, and a plurality of bearing elements, each said element having an annular bushing portion and a flange portion disposed between a respective pair of adjacent levers.

8. An eccentric mechanism as set forth in claim 1 wherein said annular bushing portion and said flange portion are separate parts.

* * * * *

UNITED STATES PATENT AND TRADEMARK OFFICE

CERTIFICATE OF CORRECTION

PATENT NO. : 4,005,736

DATED : February 1, 1977

INVENTOR(S) : ERWIN PFARRWALLER

It is certified that error appears in the above-identified patent and that said Letters Patent are hereby corrected as shown below:

Column 1, line 57, change "level" to --lever--

Signed and Sealed this

*Third* Day of *April 1979*

[SEAL]

*Attest:*

RUTH C. MASON
*Attesting Officer*

DONALD W. BANNER
*Commissioner of Patents and Trademarks*